US006135588A

United States Patent [19]

Hagiwara et al.

[11] Patent Number: 6,135,588

[45] Date of Patent: Oct. 24, 2000

[54] ELECTROSTATIC INK-JET PRINTING HEAD HAVING PROJECTIONS EXTENDING OUT OF AN INK CHAMBER

[75] Inventors: Yoshihiro Hagiwara; Junichi Suetsugu; Tadashi Mizoguchi; Hitoshi Minemoto; Hitoshi Takemoto; Kazuo Shima; Toru Yakushiji; Tomoya Saeki, all of Niigata, Japan

[73] Assignee: NEC Corporation, Tokyo, Japan

[21] Appl. No.: 08/990,019

[22] Filed: Dec. 12, 1997

[30] Foreign Application Priority Data

| | | | |
|---|---|---|---|
| Dec. 13, 1996 | [JP] | Japan | 8-333910 |
| Dec. 20, 1996 | [JP] | Japan | 8-341048 |
| Dec. 20, 1996 | [JP] | Japan | 8-341049 |

[51] Int. Cl.[7] ..... B41J 2/06

[52] U.S. Cl. ..... 347/55

[58] Field of Search ..... 347/55, 154, 103, 347/123, 40, 42, 151, 120, 141, 17, 128, 111, 159, 84, 85, 86, 87; 399/271, 290, 292, 293, 294, 295

[56] References Cited

U.S. PATENT DOCUMENTS

| | | |
|---|---|---|
| 4,271,416 | 6/1981 | Shimizu et al. . |
| 5,471,233 | 11/1995 | Okamoto et al. . |
| 5,539,438 | 7/1996 | Maeda . |

FOREIGN PATENT DOCUMENTS

| | | | |
|---|---|---|---|
| 0 624 472 | 11/1994 | European Pat. Off. . | |
| 0 703 081 | 3/1996 | European Pat. Off. . | |
| 0703080 A2 | 3/1996 | European Pat. Off. | 347/55 |
| 0 827 831 | 3/1998 | European Pat. Off. . | |
| 58-153661 | 9/1983 | Japan . | |
| 58-153662 | 9/1983 | Japan . | |
| 60-228162 | 11/1985 | Japan . | |
| 61-57343 | 3/1986 | Japan . | |
| 8-309993 | 11/1996 | Japan . | |
| 410202881 | 8/1998 | Japan . | |

*Primary Examiner*—John Barlow
*Assistant Examiner*—Raquel Yvette Gordon
*Attorney, Agent, or Firm*—Young & Thompson

[57] ABSTRACT

An electrostatic ink-jet printing head in which ink containing charged toner particles in an insulating solvent is supplied from an ink reservoir, an electric field is applied to the ink to generate an electrostatic force, and the electrostatic force causes the toner particles to be ejected from ink ejecting ports. The electrostatic ink-jet printing head comprises a head block including a head block main body which defines an ink chamber and also including a base film which is assembled on the head block main body. The base film has ink ejecting ports and has a plurality of projections extending from one edge of the ejecting port into the ejecting port. The ejecting ports, ejecting electrodes and ejecting projections are collectively formed on a base film by a TAB technique, and by bending the base film at the ejecting ports having projections according to the shape of the head block main body.

20 Claims, 16 Drawing Sheets

ELECTROSTATIC INK-JET PRINTING HEAD HAVING PROJECTIONS EXTENDING OUT OF AN INK CHAMBER

BACKGROUND OF THE INVENTION

1. Field of the Invention

The present invention relates to electrostatic ink-jet printing heads, and more particularly, for ejecting toner particles from ink ejecting ports onto a printing medium under influence of electrostatic power.

2. Description of the Related Art

Recent attention has been focused on a non-impact printing method in which printing noise generated during printing is reduced to a negligible level. Among such methods, an ink-jet printing method has an advantage to enable high-speed printing directly on a printing medium, and also even on plain paper, with use of a simple mechanism.

Various sorts of ink-jet printing methods have been proposed so far. One of such ink-jet methods is an electrostatic ink-jet printing method. In this method, a plurality of ejecting electrodes are provided in front of printing paper and a single counter-electrode is provided in back thereof. When a voltage is applied across the plurality of ejecting electrodes and counter-electrode, an electrostatic force of electric field is generated between them and colored material such as ink is ejected toward the printing paper for printing. The ink used in this method contains charged toner particles in a carrier liquid as an insulating solvent.

An example of an electrostatic ink-jet printing head is disclosed in Japanese Patent Application Laid-open Publication No.60-228162. FIG. 19 is a perspective view of this prior art printing head. The printing head 1 comprises a head base 2 made of insulating material and an upper cover 3 provided opposed thereto. On a surface of the head base, a plurality of ejecting electrodes 4 are provided. The head base has a plurality of protrusions 5 underlying the respective ejecting electrodes 4. The upper cover 3 is positioned on the head base 2 recessed from the ends of the protrusions 5. Between the head base 2 and the upper cover 3, slit-like ink ejecting opening 6 is defined. The ink ejecting opening 6 is connected to ink tank portion 7 which the head base 2 and upper cover 3 also define therebetween. The ink stored in the ink tank portion 7 is supplied to the ink ejecting opening 6 by capillarity. The ink positioned at the ink ejecting electrode 4 has a pointed shape according to corresponding protrusion 5. Because of the shape, the electrical field caused by applying high voltage on an ejecting electrode 4 focuses the ink in the vicinity of ejecting electrode 4 and the ink is easily propelled to paper.

Another example of an electrostatic ink-jet printing head is disclosed in Japanese Patent Application Laid-Open Publication Nos. 58-153661 and 58-153662. FIG. 20 is a perspective view of major parts of this prior art printing head, and FIG. 21 is a cross-sectional view thereof. In the ink-jet printing head disclosed in these two publications, a plurality of nozzles 12 having a first electrode 13, 14 on an inner wall of each nozzle or in the vicinity thereof are disposed in a two-dimensional X and Y array within a head base 2, and the first electrode 13, 14 forms a common lead terminal with respect to a Y direction (printing-paper feeding direction) of the nozzle group. A second electrode 15, 16, 17 common with respect to the X direction (printing-paper width direction) of the nozzle group is disposed behind the first electrode, and a third electrode (not shown) is disposed in front of the first electrode, i.e., on its printing side, so that a generated electric field causes toner particles in ink 18 to be ejected from the nozzle group onto a printing paper to thereby print an image on the paper.

In this latter prior art, however, every nozzle respectively has a electrode on an inner wall of the nozzle or in the vicinity thereof disposed in a two-dimensional X and Y array, and the first electrode forms a common lead terminal with respect to a Y direction (printing-paper feeding direction) of the nozzle group or in an X direction (printing-paper width direction). The structure of these nozzles is so complicated that this structure has made it difficult to reduce printing-head manufacturing costs.

Further, the slit-like ink ejecting opening of the former prior art is formed as very narrow slit and the nozzles of the latter prior art are formed as very small holes to suppress an ink flow in the vicinity of the end of the opening or nozzles to be low to thereby prevent ink leakage. For this reason, in openings or nozzles whose ink ejection frequency is low, excessively concentrated toner particles cause the toner particle density to become high to thereby increase the ink viscosity. This causes generation of improper ejecting of the ink droplet, which leads to a reduction in the printing quality of the printing paper.

SUMMARY OF THE INVENTION

In view of the above problems, it is an object of the present invention to provide an electrostatic ink-jet printing head which can be manufactured with low costs and with a simple arrangement and can be high in reliability and good in yield.

Further, another object of the present invention is to provide an electrostatic ink-jet printing head which prevents the ink flow from being suppressed in the vicinity of the end of opening or nozzles and stably supplies toner particles to ink ejecting ports to obtain a good printing quality.

For the purpose of attaining the above objects, there is provided an electrostatic ink-jet printing head comprising: a base film comprising a plurality of ejecting electrodes, at least one ejecting port, a plurality of projections extending from a edge of said ejecting port into said ejecting port, each projection positioned in the vicinity of an end of a respective one of said plurality of ejecting electrodes; and a head block main body on which said base film is assembled to define therebetween an ink chamber communicating with each ejecting port, said base film curved at each projection so that said each projection protrudes out of said ink chamber.

In the electrostatic ink-jet printing head of the present invention, by making the base film curved at every projection on the head block main body so that the projections protrude out of said ink chamber, the major parts of the printing head can be formed. Consequently, a pointed meniscus corresponding to each ejecting electrode is formed by this simple structure. Thus, the ejection of ink can be stable, the manufacturing process of the printing head can be made simple and manufacturing costs can be made low.

Because the ejecting ports are formed on a film, the ink can be smoothly circulated in the vicinity of the ejecting ports and printing electrodes, excessive toner particles or counter ions can be forcibly expelled from the vicinity of the ejecting ports and printing electrodes and thus the density of the toner particles can be stably maintained.

DETAILED DESCRIPTION OF PREFERRED EMBODIMENTS

Figure 1:
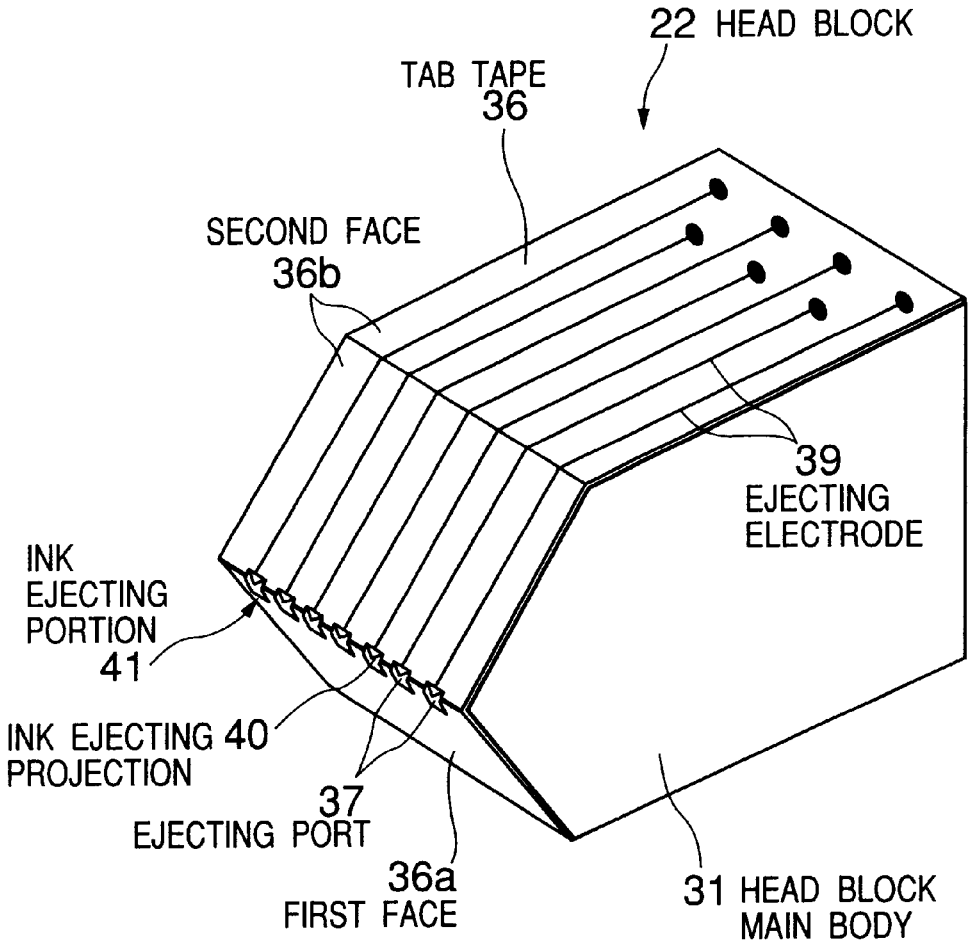
FIG. 1 is a perspective view of an electrostatic ink-jet printing head in accordance with a first embodiment of the present invention.

The present invention will be explained in more detail with reference to the accompanying drawings.

As shown in FIGS. 1–4, a printing head comprises a head block 22 and a counter-electrode 32 spaced by a predetermined distance from a tip end of the head block 22. The head block 22 includes a head block main body 31 and a TAB tape 36 assembled on the head block main body 31.

An ink-jet printer having the present printing head mounted therein is provided with an ink reservoir (not shown) storing ink 34 containing charged toner particles in an insulating solvent. The ink reservoir is fluidly coupled via a tube to an ink chamber 30 (to be later explained) provided in the printing head. Application of a head or pressure difference of about 1 $cmH_2O$ between the ink reservoir and ink chamber 30 causes the ink 34 to be forcibly circulated. The ink 34 is manufactured by dispersing a charged control agent and fine particles of colored thermoplastic resin (so-called, toner particles) in a petroleum organic solvent (isoparaffin), the toner particles being apparently positively charged.

Figure 2:
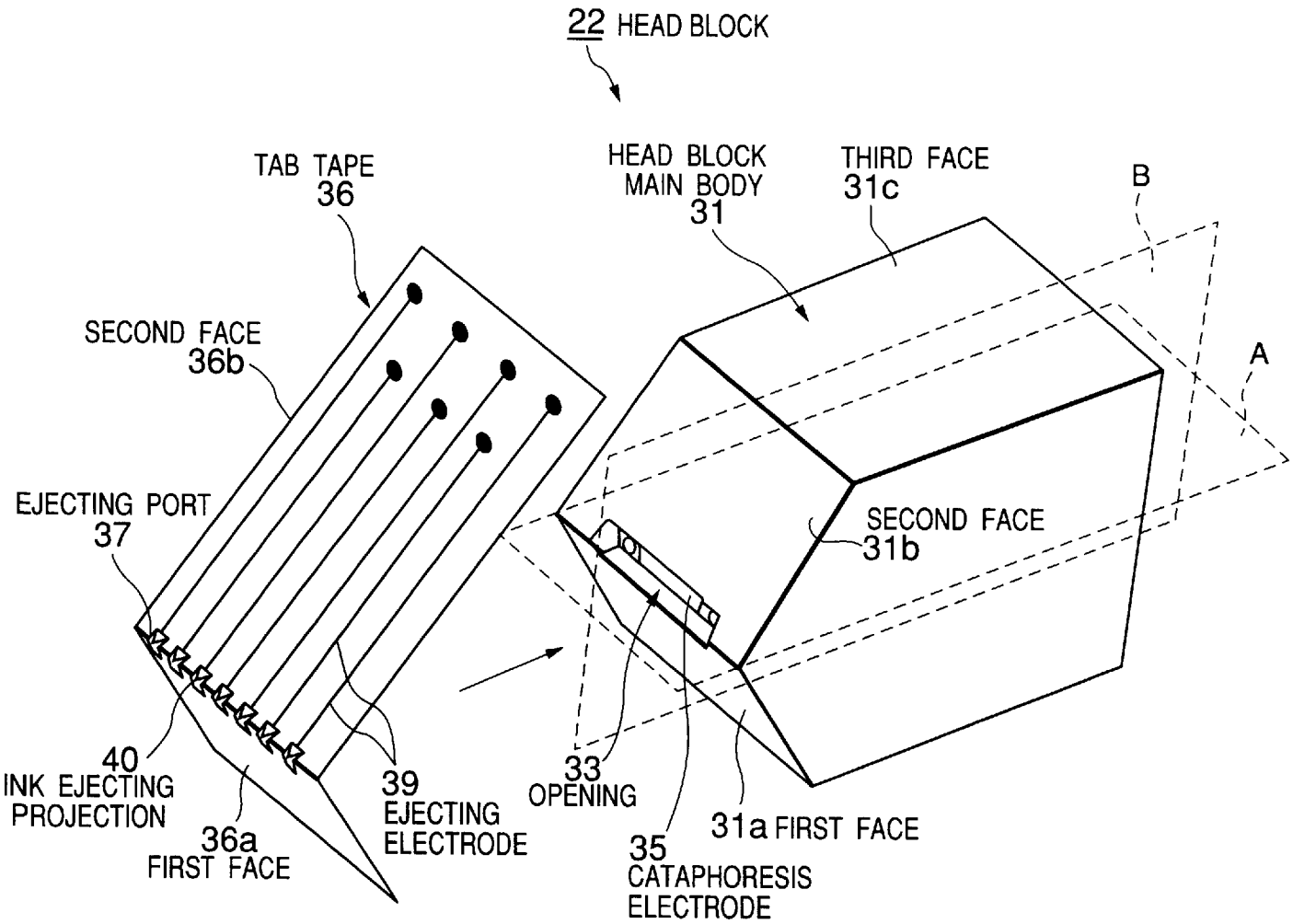
FIG. 2 is a perspective view of a head block of FIG. 1 when a TAB tape is removed from a head block main body.

As shown in FIGS. 1 and 2, the head block main body 31 of the head block 22 is made of an insulating material such as a plastic material having a nearly rectangular column shape, and the central part of a side of the head block is projected toward the counter electrode 32 and has a horizontally extended arris line. The projected part has a first face 31*a* directed obliquely downwards and a second face 31*b* directed obliquely upwards, and the opening 33 of the ink chamber 83 opens on a part of the arris line.

Figure 3:
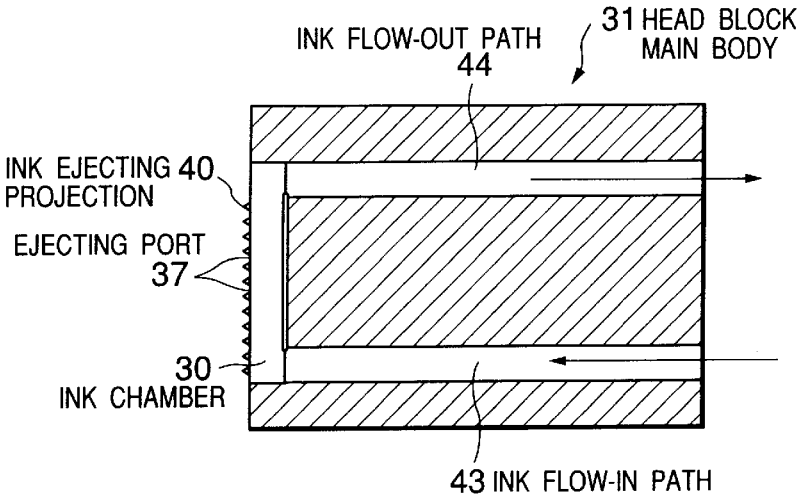
FIG. 3 is a cross-sectional view of the head block main body of FIG. 2 taken along an imaginary plane A passing through an arris line as viewed from its lower side.
Figure 4:
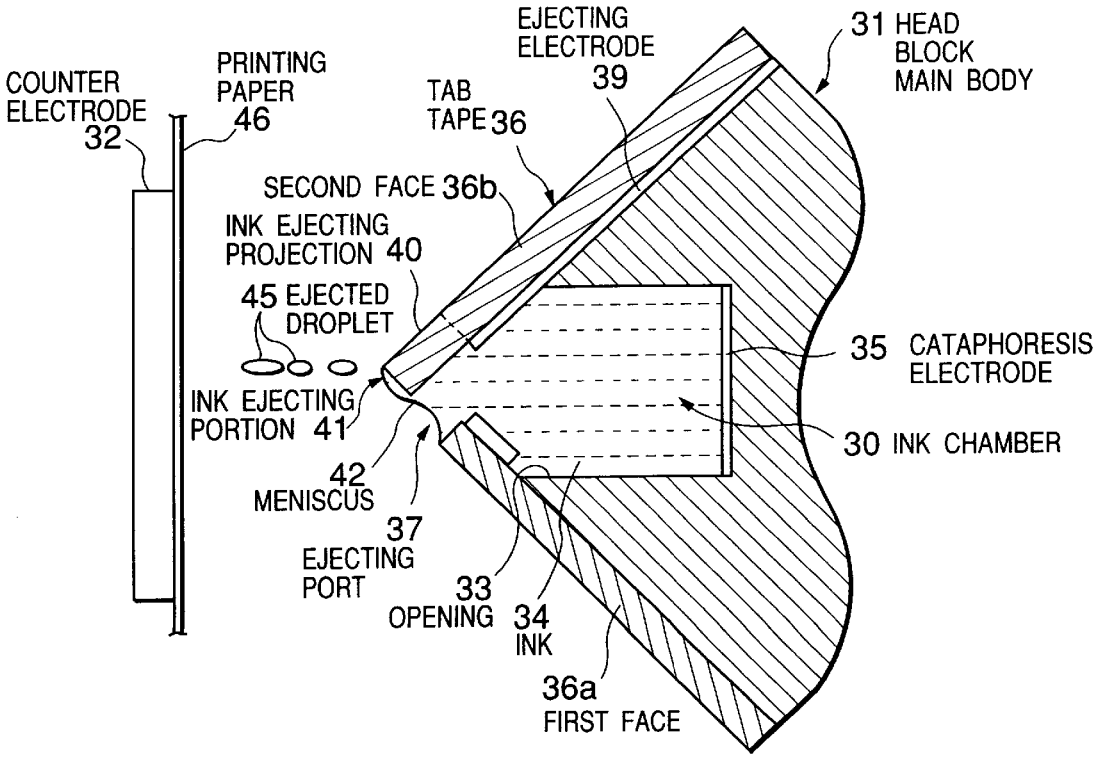
FIG. 4 is a cross-sectional view of the head block main body of FIG. 2 taken along an imaginary plane B perpendicular to the imaginary plane A and passing through the center of the opening.
Figure 5:
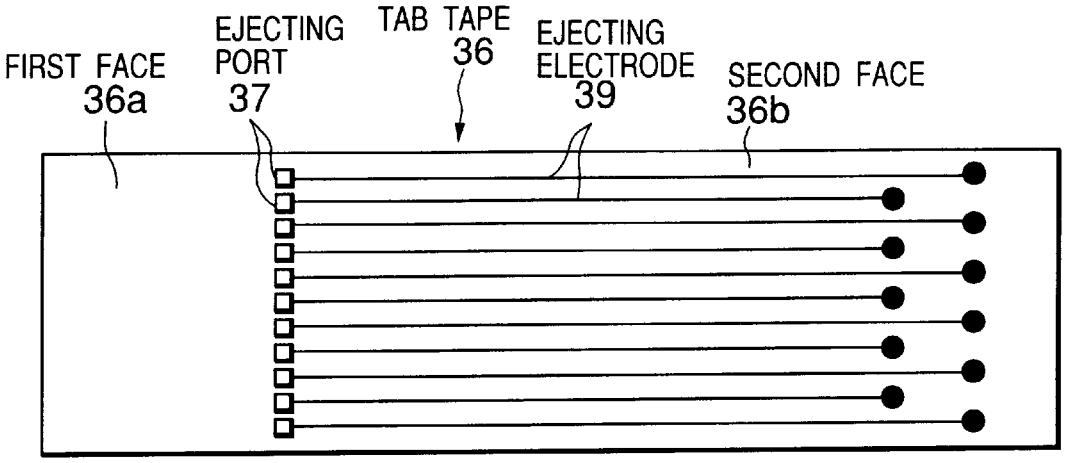
FIG. 5 is a plan view of a TAB tape in accordance with the present invention.

As shown in FIG. 4, a single cataphoresis electrode 35 is fixedly mounted to be parallel to the arris line on a rear side of the ink chamber 30. The cataphoresis electrode 35 applies a cataphoresis voltage to the ink 34, whereby toner particles in the ink 34 are concentrated and made dense by an electrophoresis phenomenon and then supplied to the vicinity of the ink ejecting portions 41. The head block main body 31 has further formed therein an ink flow-in path 43 and an ink flow-out path 44 which communicate with the ink chamber 30, so that the ink 34 is circulated from the ink reservoir into the ink chamber 30 via the ink flow-in path 43 and ink flow-out path 44, as shown in FIG. 3.

Bonded to the head block main body 31 from the first face 31*a* to the third face 31*c* is the tape material (which will be referred to as the TAB tape, hereinafter) 36 employing a tape automated bonding (TAB) technique. The TAB tape 36 is made of insulating material such as polyimide, has a rectangular shape as a whole and also has a thickness of about 50 $\mu$m. The TAB tape 36 has a first face 36*a* corresponding to the first face 31*a* of the head block main body 31 and a second face 36*b* corresponding to the second face 31*b* thereof.

The TAB tape 36 has formed therein a plurality of ejecting ports 37 of a nearly square shape which correspond to the openings 33 and which are formed at a desired resolution pitch when bonded to the head block main body 31 and when bent-along a folded line Fo between the first and second faces 36*a* and 36*b*. In this way, by merely bonding the TAB tape 36 onto the head block main body 31, the plurality of ejecting ports 37 can be formed, whereby the step of forming the ejecting ports 37 can be made simple.

The TAB tape 36 has integrally formed on its rear side ejecting electrodes 39 which are associated with the respective ejecting ports 37 in a longitudinal direction of the TAB tape 36. The ejecting electrodes 39 are made by plating electrically conductive material in a pattern to have a thickness of 20–30 $\mu$m at a pitch of, e.g., 300 dpi, that is at intervals of about 85 $\mu$m. The respective ejecting electrodes 39 are led out to one end side of the TAB tape 36 and then connected to external electrodes (drivers).

Figure 6:
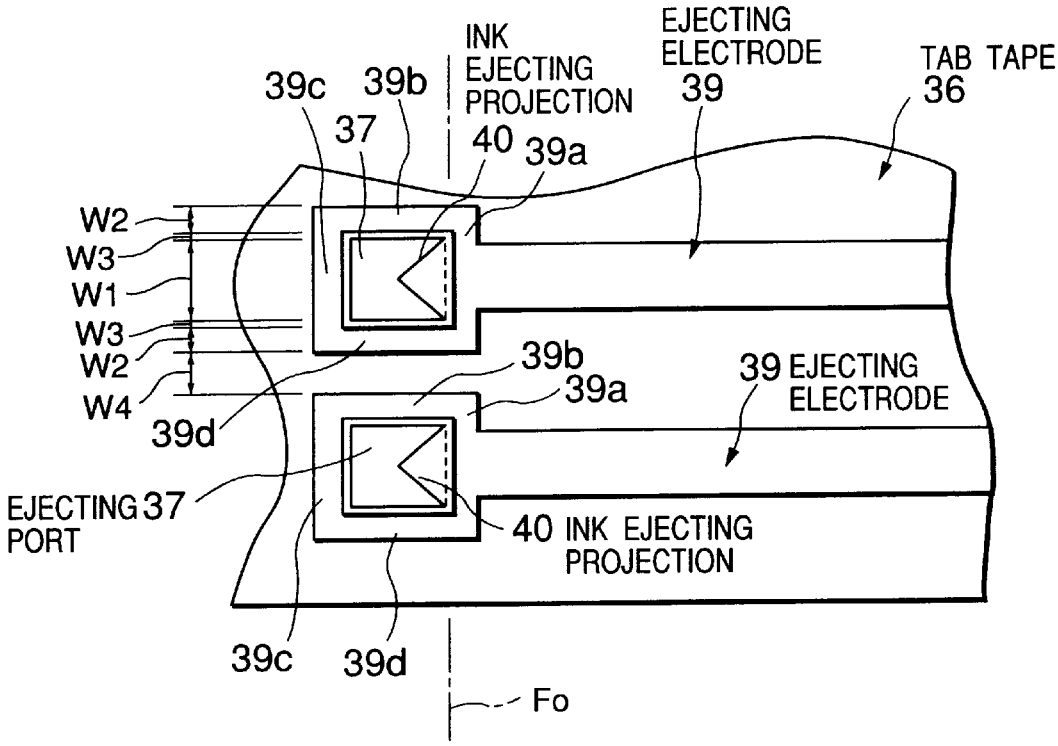
FIG. 6 is an enlarged plan view of the ejecting ports of a first example of a TAB tape.

The TAB tape 36, when folded along the folding line Fo shown in FIG. 6 at a position opposed to the opening 33 of the head block main body 31, has ink ejecting projections 40 of such a shape as to clearly define the ejecting positions in the ink ejecting portions 41, for example, a shape having a pointed angular part, which project from the tip end of the head block main body 31 toward a counter-electrode 32. The ink ejecting projections 40 extend in an isosceles triangle shape from one side of the ejecting ports 37 on the side of the ejecting electrodes 39 toward the centers of the ejecting ports 37.

Each of the ejecting electrodes 39 is formed at its tip end with a square-shaped frame which has sides 39*a*, 39*b*, 39*c* and 39*d* corresponding to the respective sides of the ejecting ports 37. Since the frames are integrally formed with the TAB tape 36 at the periphery of the associated ejecting ports 37, the respective ejecting ports 37 can be completely defined by the ejecting electrodes 39. Since the ejecting electrodes 39 are coated on their surfaces with an insulating film and thus are electrically individually separated, the electrodes are individually potential-controlled electrically independently.

With the electrostatic ink-jet printing head having the aforementioned arrangement, when a cataphoresis voltage is applied to the cataphoresis electrode 35, this causes an electric field directed from the cataphoresis electrode 35 to the counter-electrode 32 to be generated within the ink chamber 30. This electric field causes the toner particles in the ink 34 to migrate toward the ejecting ports 37 at an electrophoresis speed corresponding to the electric field. This results in that the ink 34 has menisci 42 at the tip ends of the projections 40 based on surface tension and thus a wet condition of ink 34 is always established in the vicinity of the ink ejecting ports 37.

The toner particles are supplied to the vicinity of the ejecting electrodes 39 through the forcible ink circulation of a pump. The toner particles are further migrated by the electrophoresis phenomenon so that the toner particle density in the vicinity of the ink ejecting ports 37 becomes higher than that of the ink 34 at the flow-in side of the ink chamber 30.

Counter-ions having a reverse polarity opposite to the charge of the toner particles are generated by the migration of the toner particles based on the electrophoresis phenomenon, so that the counter-ions move in a direction opposite to the toner particles and are adsorbed by the cataphoresis electrode 35.

When an electric field directed from the cataphoresis electrode 35 to the counter-electrode 32 is generated, and a high pulse voltage having a predetermined width is applied to specific ejecting electrodes 39, the density of the electric field around the ink ejecting ports 37 is abruptly increased. This causes an electrostatic force to act on the toner particles, whereby the toner particles migrate to the tip ends of the menisci 42 and are concentrated thereon under the influence of the electrostatic force. Thereafter, when the electrostatic force to the toner particles overcomes the surface tension or viscous force of the meniscus 42 of each projection 40, fine ejected droplets 45 containing the toner particles are ejected from the projections 40 toward the counter-electrode 32 at a timing synchronized with an applied voltage. The ink 34 is supplied from the ink reservoir to the ink chamber 30, and the ink 34 containing excessive toner particles is forcibly returned to the ink reservoir. The above operations are repeated to thereby print an image based on print data on the printing paper 46 positioned on the counter-electrode 32. The printed image is heated by a heater (not shown) to be fixed on the printing paper 46.

During the above printing operation, the ejecting ports 37 are surrounded by the frames at the tip ends of the ejecting electrodes 39, so that, when a pulse voltage is applied to adjacent ejecting electrodes 39, the influence of the pulse voltage is suppressed by the potential of the frames of the ejecting electrodes 39 around the ejecting ports 37. Thus, there can be avoided the prior art disadvantage wherein ink 34 forming the ink meniscus flows disadvantageously among the plurality of ink ejecting portions 41. As a result, since no crosstalk by ejected toner particles from adjacent ejecting ports 37 interfering with each other is generated, an image printing quality to the printing paper 46 can be stabilized.

With the present printing head 24, simply by applying the TAB tape 36 including projections 40 and the plurality of ejecting electrodes 39 associated with the plurality of respective projections 40 and coated with the insulating material to the head block main body, the major parts of the printing head 24 can be formed. For this reason, the manufacturing process of the printing head 24 can be made simple and its manufacturing costs can be reduced. Further, since the ink 34 is smoothly circulated in the vicinity of the projections 40 and ejecting electrodes 39, excessive toner particles and counter-ions can be forcibly expelled from the vicinity of the ejecting electrodes 39, thus enabling stable maintenance of the toner particle density.

Another example of TAB tape of the present embodiment will be explained with reference to FIGS. 7 to 9.

Figure 7:
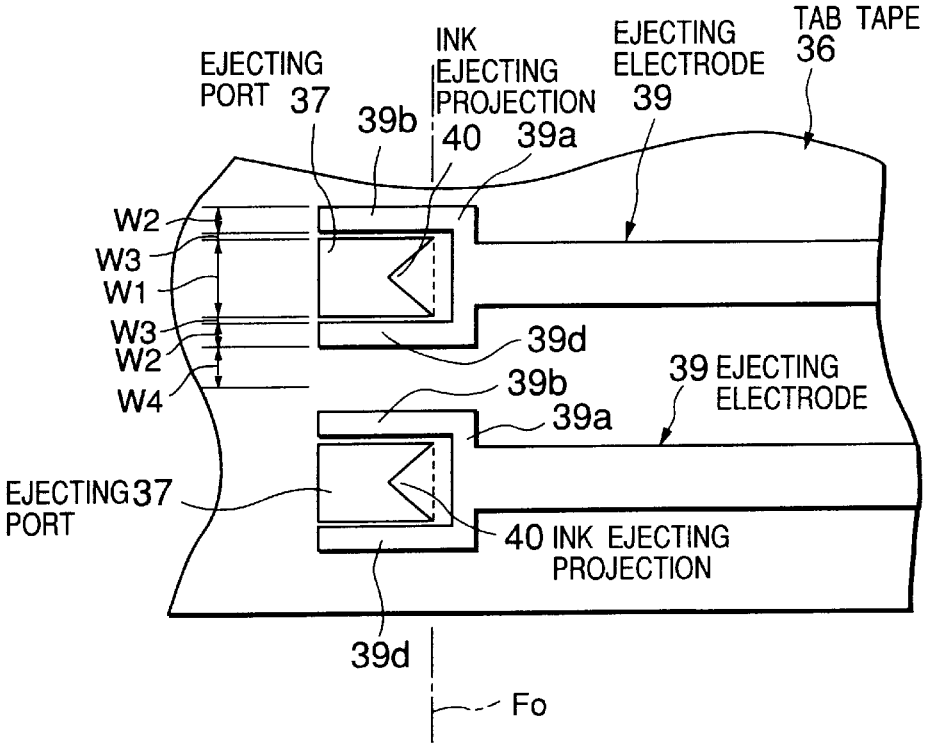
FIG. 7 is an enlarged plan view of the ejecting ports of a second example of a TAB tape.

FIG. 7 is a view of second example of the TAB tape in which the sides 39*c* of the frames at the tip ends of the ejecting electrodes 39 of FIG. 6 are removed so that the ejecting port 37 is surrounded by a total of three sides, that is, the two sides 39*b* and 39*d* perpendicular to the direction of the row of ejecting ports 37 as well as the side 39*a* on the side of the ejecting electrode 39. Further, FIG. 8 is a view of a third example of the TAB tape in which the sides 39*b* of the frames of the ejecting electrodes 39 of FIG. 6 perpendicular to the direction of a row of frames are removed from the arrangement of the TAB tape in the first example so that the ejecting port 37 is surrounded by a total of three sides, that is, the two sides 39*a* and 39*c* along the direction of the row of the ejecting ports 37 as well as the side 39*d* perpendicular to the row direction. Even in these second and third examples, as in the first example of FIG. 6, there are formed the ink ejecting projections 40 which extend toward the centers of the ejecting ports 37.

In any of the examples, when it is desired to integrally form the TAB tape 36 with the ejecting electrodes 39, a resist film is first laminated on the TAB tape 36 and the ejecting electrodes 39 are electric-field plated as stacked on areas of the TAB tape not formed with the resist film. In this case, in order to sufficiently closely contact the resist film with the TAB tape 36, a certain extent of contact area is necessary. In the examples of FIGS. 7 and 8, the sides 39*c* or 39*b* are removed from the tip ends of the ejecting electrodes 39 of FIG. 6, so that the parts surrounded by the tip ends of the ejecting electrodes 39 will not be isolated from the other parts, which results in that the adhesion strength of the resist film to the parts surrounded by the tip ends will not increase unnecessarily. Accordingly, the density of the ejecting electrodes 39 can be further increased, leading to improved printed image row resolution.

Through the aforementioned steps, the density of the ejecting ports 37 can be made high. In order to form a higher density of pattern, consideration should be paid also to a limit of the electrode width capable of being formed on the TAB tape 36. For example, in such patterns as shown in FIGS. 6 and 7, a minimum pitch of the row of the ejecting ports 37 is determined as follows.

$$L\min = W1 + 2\times(W2 + W3) + W4 \quad (1)$$

where Lmin denotes a minimum pitch, W1 denotes the width of the ejecting port, W2 denotes the width of the electrode, W3 denotes a hole making margin, and W4 denotes an interval between the adjacent ejecting ports.

In accordance with the equation (1), the minimum pitch Lmin depends only on the manufacturing tolerances of the TAB tape 36.

Figure 8:
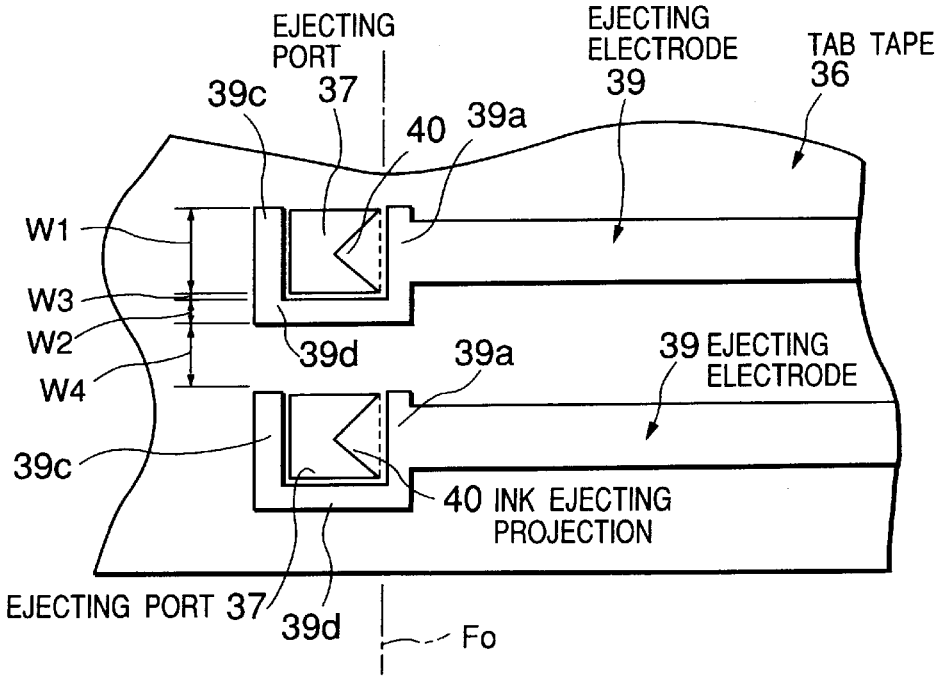
FIG. 8 is an enlarged plan view of the ejecting ports of a third example of a TAB tape.

In such a pattern as shown in FIG. 8, the minimum pitch of the row of the ejecting ports 37 is determined as follows.

$$Lmin=W1+W2+W3+W4 \quad (2)$$

In accordance with the equation (2), the minimum pitch Lmin depends solely on the manufacturing tolerances of the TAB tape 36.

Figure 9:
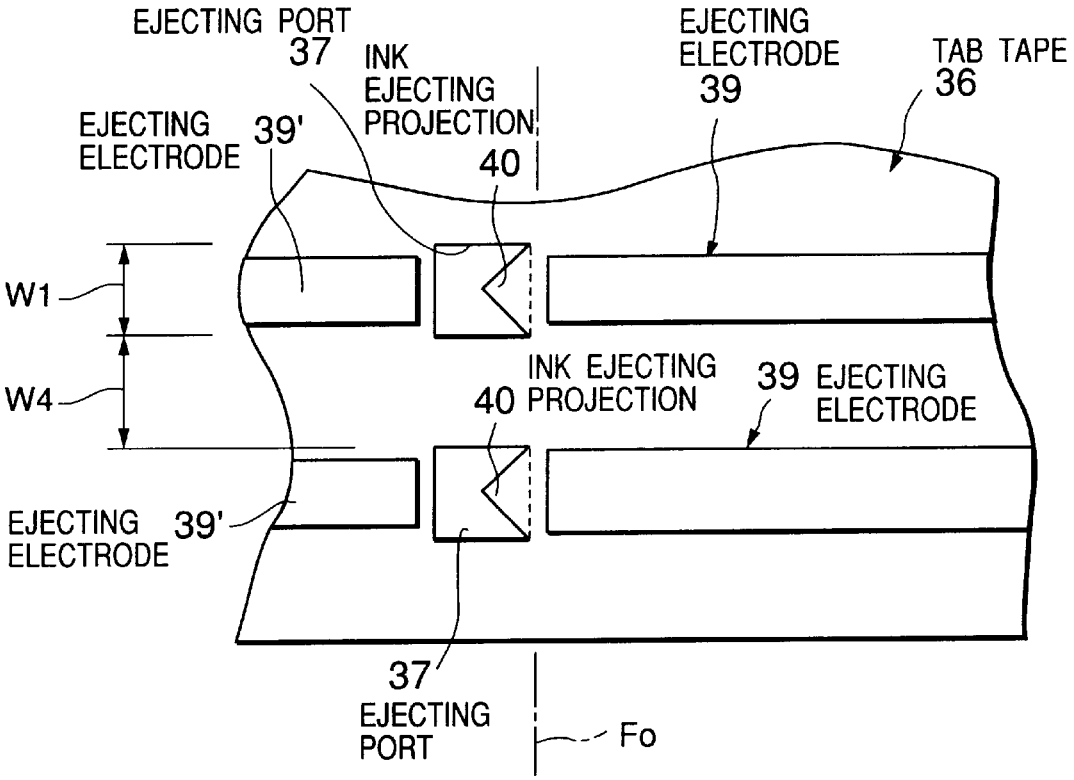
FIG. 9 is an enlarged plan view of the ejecting ports of a fourth example of a TAB tape.

FIG. 9 is fourth example of a TAB tape in which all four sides 39*a,* 39*b,* 39*c* and 39*d* of the frames at the tip ends of the ejecting electrodes 39 of FIG. 6 are removed from the arrangement of the TAB tape in the first example, and the ejecting electrodes 39 (39') are disposed at a total of two peripheral edges of each ejecting port 37, that is, one side on the lead side of the ejecting electrode 39 to the driver as well as one side positioned on the opposite side to the lead side with the ejecting port 37 interposed therebetween. In this example, as in the example of FIG. 6, the ink ejecting projections 40 are formed to extend toward the centers of the ejecting ports 37. In such a pattern as shown in FIG. 9, the minimum pitch of a row of the ejecting ports 37 is determined as follows.

$$Lmin=W1+W4 \quad (3)$$

In accordance with the equation (3), the minimum pitch Lmin depends solely on the manufacturing tolerances of the TAB tape 36.

With respect to the respective TAB tapes 36 shown in FIGS. 6 to 9, when it is assumed that their manufacturing capability is the same, printing heads having resolutions increasing in the order of FIGS. 6 to 9 can be manufactured; the ability of the printing heads to prevent crosstalk generated under the influence of the electric field between the adjacent ejecting ports 37 is increasing in the order of FIGS. 9 to 6.

Although the ejecting ports 37 have been formed to have a nearly rectangular shape in the foregoing first to fourth examples, the shape of the ejecting ports 37 is not limited to the specific example, but may be, for example, circular.

Next, a further embodiment of the present invention will be explained with reference to FIGS. 10–13.

Figure 10:
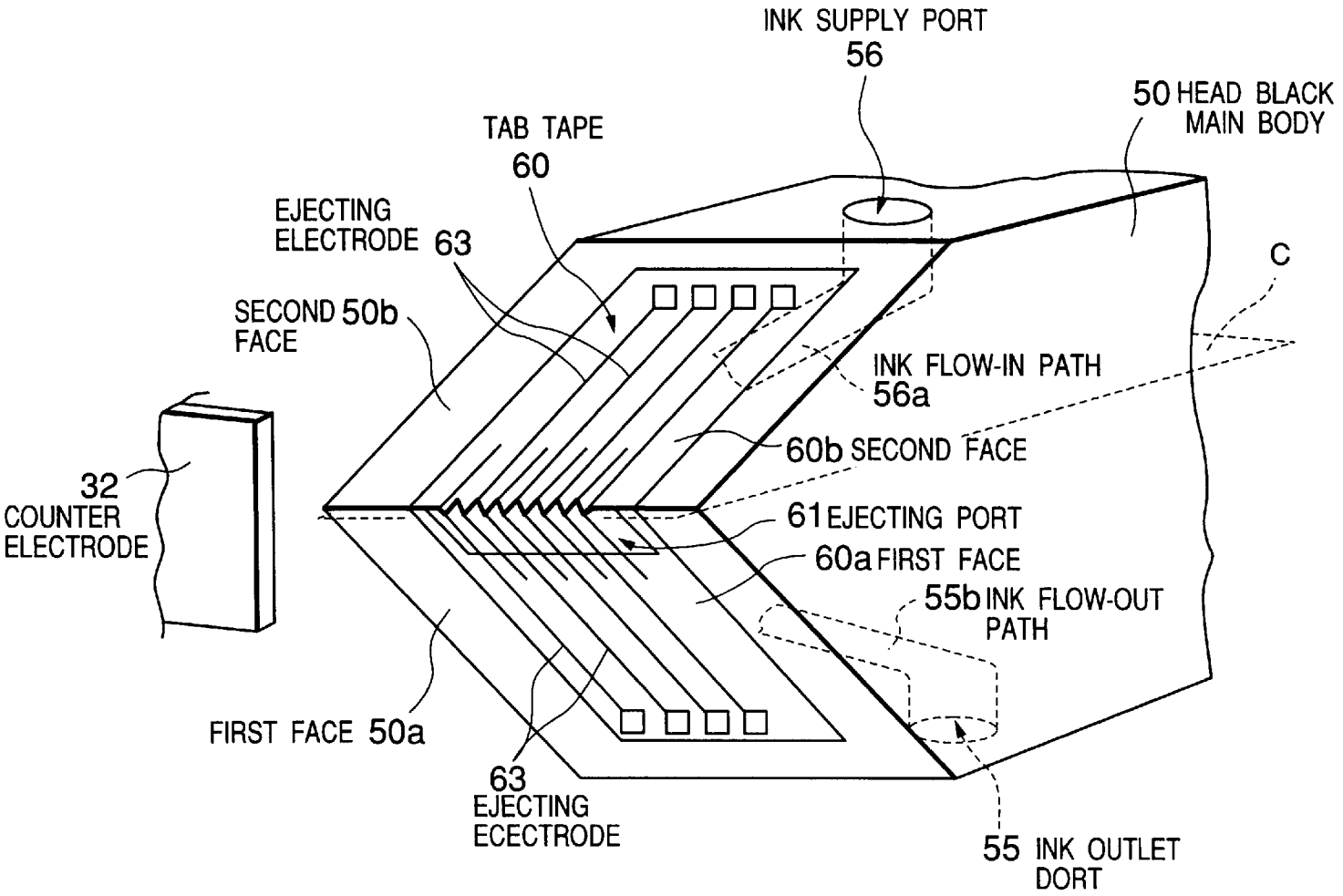
FIG. 10 is a perspective view of an electrostatic ink-jet printing head in accordance with a further embodiment of the present invention.
Figure 11:
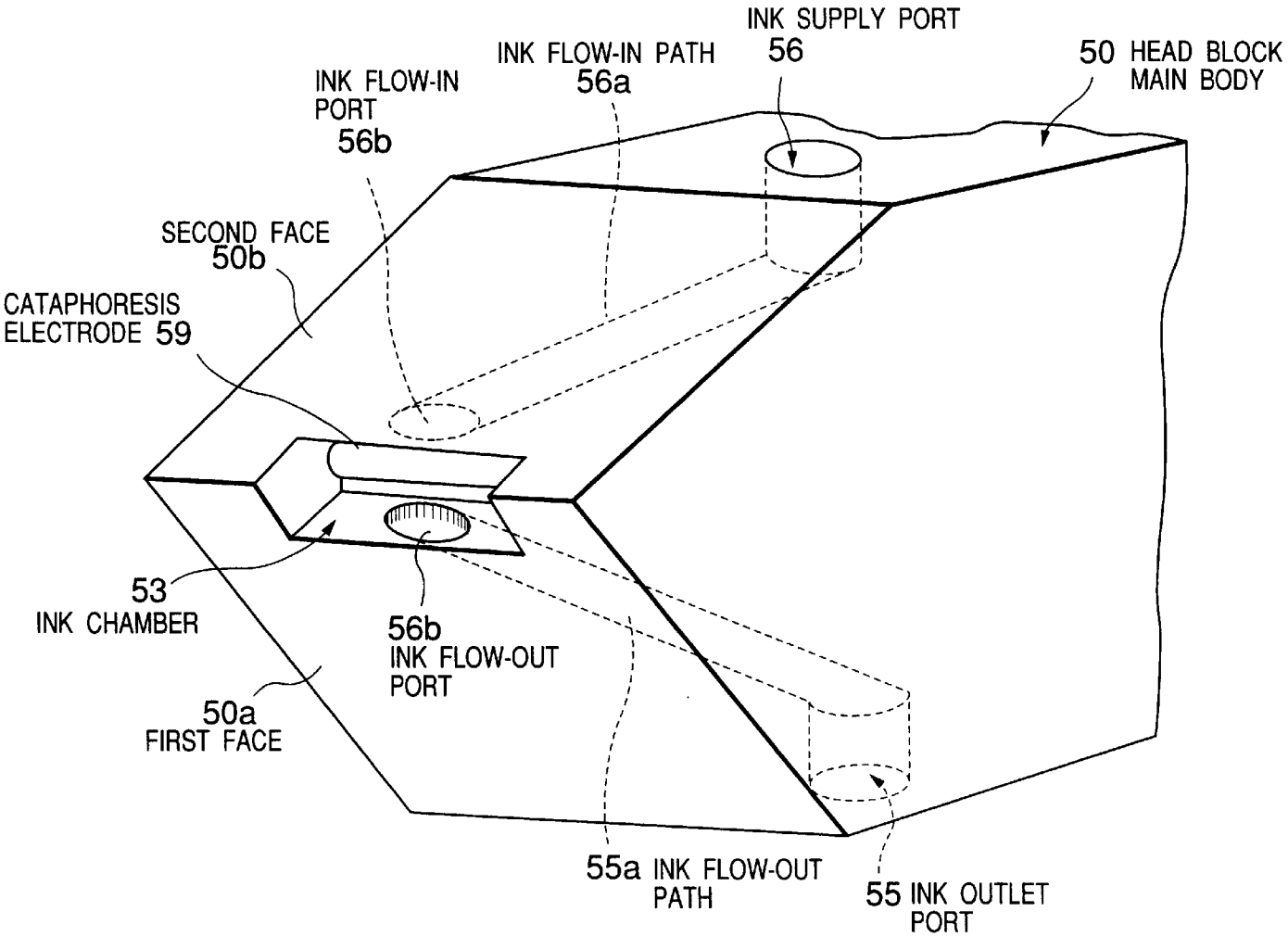
FIG. 11 is a perspective view of a head block of the printing head of FIG. 10 when a TAB tape is removed from a head block main body.

In this embodiment, the head block main body 50 is provided in its upper and lower surfaces with an ink supply port 56 and an ink outlet port 55 which communicate with the ink reservoir as shown in FIG. 10. The ink chamber 53 is provided with an ink inlet port 56*b* which communicates with the ink supply port 56 via an ink flow-in path 56*a* and with an ink flow-out port 55*b* which communicates with the ink outlet port 55 via an ink flow-out path 55*a*. The ink 34 is circulated from the ink reservoir via the ink supply port 56, ink flow-in path 56*a,* ink inlet port 56*b,* ink chamber 53, ink flow-out port 55*b,* ink flow-out path 55*a* and ink outlet port 55.

The ink flow-in path 56*a* faces toward the arris line where the ejecting port 61 of TAB tape is positioned so that an ink flow into the ink chamber 53 is always directed toward the ejecting port 61, whereby the ink 34 in the vicinity of the ejecting port 61 is always replaced by the circulating ink flow.

Figure 12:
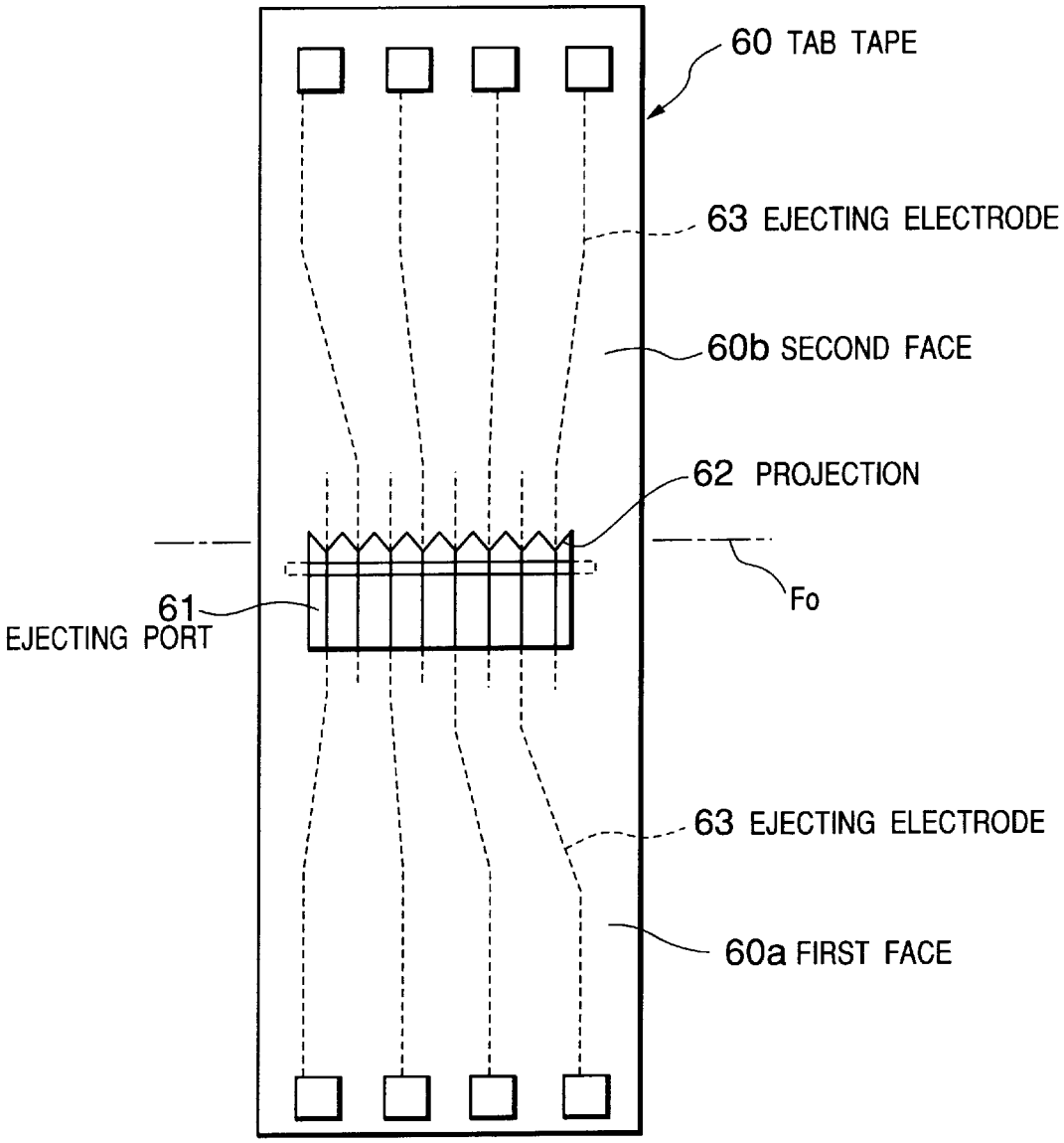
FIG. 12 is a plan view of an example of the TAB tape.

With respect to FIG. 12, the TAB tape 60 has formed therein an ejecting port 61 of a nearly rectangular shape and an edge of the ejecting port 61 located on the side of the second face 60*b* is formed with ink ejecting projections 62 which extend into the ejecting port 61 in a saw-tooth shape at a pitch corresponding to a resolution. The respective projections 62, when the TAB tape 60 is folded at a position opposed to the ink chamber 53 of the head block main body 50, extend from the projected part of the head block main body 50 toward the counter-electrode 32 to define ink ejecting positions corresponding to respective ejecting electrodes 63 in the ejecting port 60. The ejecting electrodes 63 span the ejecting port 61 via the respective tip ends of the projections 62 in bridge form. The ejecting electrodes 63 are alternately formed on the first and second faces 60*a* and 60*b* of the TAB tape 60 and connected to a driver via external electrodes. The ejecting electrodes 63 on the second face 60*b* extend to a side edge of the first face 60*a* adjacent alternate projections 62. The other half of ejecting electrodes 63 extend from a side edge of the second face 60*b* onto the first face 60*a* adjacent the remaining projections, and are bonded onto the first face 60*a*.

The ejecting electrodes 63 including the bridge parts corresponding to the projections are entirely coated with insulating coating material by a chemical deposition process of Parylen resin. In particular, the bridge parts of the ejecting electrodes 63 are on their surfaces evenly coated with the insulating coating material to have a thickness of about 10 μm or less, thereby ensuring isolation from the contacted ink 34. Further, the bridge parts can be linearly extended from both edges of the ejecting port 61 without curvature, when the TAB tape 60 is bonded onto the head block main body 50 with folding at the bent line Fo.

Figure 13:
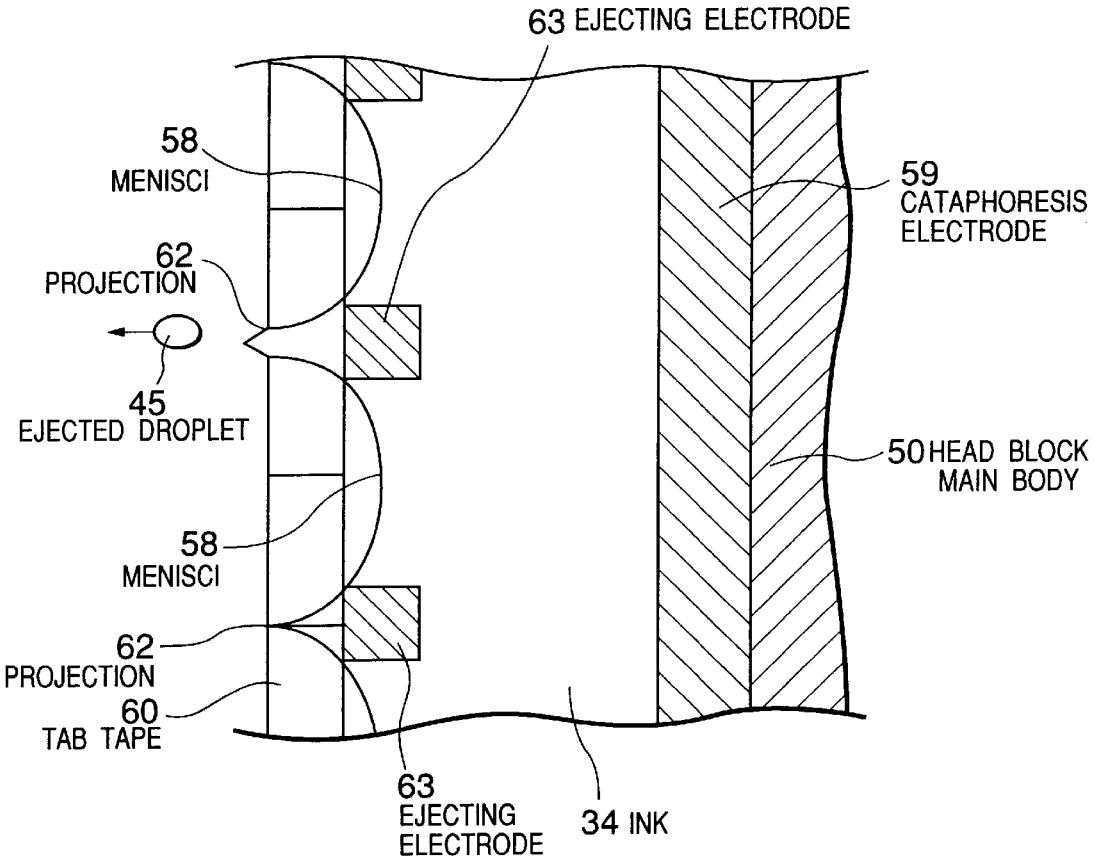
FIG. 13 is a cross-sectional view of the head block of FIG. 10 taken along an imaginary plane C passing through an arris line as viewed from its lower side.
Figure 14:
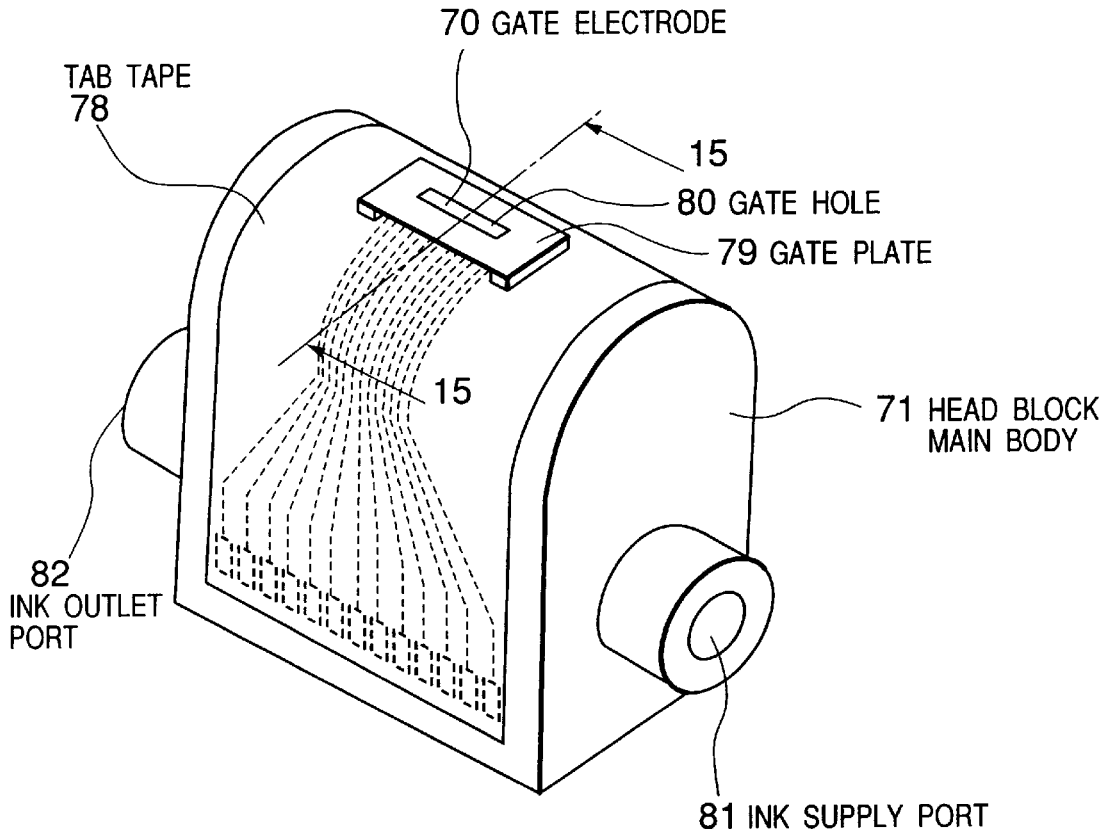
FIG. 14 is a perspective view of an electrostatic ink-jet printing head in accordance with a still further embodiment of the present invention.
Figure 15:
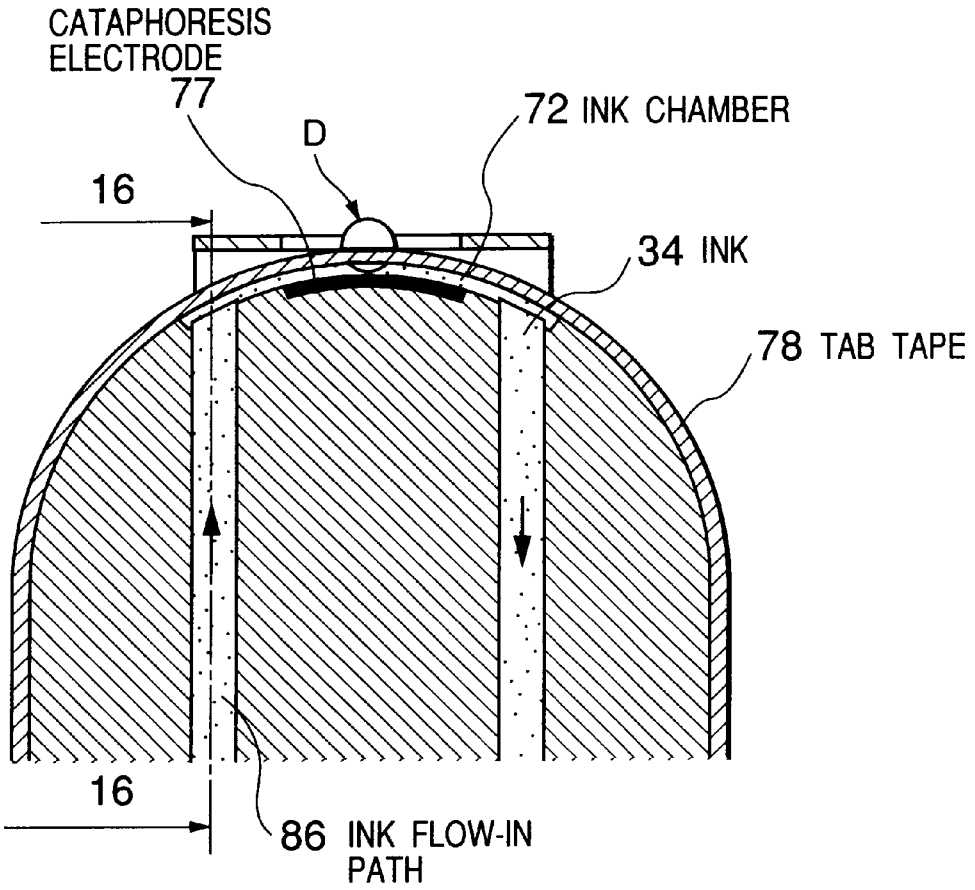
FIG. 15 is a cross-sectional view taken along line 15—15 in FIG. 14.

With the electrostatic ink-jet printing head having the aforementioned arrangement, when a voltage having the same polarity as a toner particle potential is applied to the cataphoresis electrode 59, the ink 34 has menisci 58 based on surface tension at the tip ends of the projections 62 as shown in FIG. 13. This phenomenon occurs because the plurality of projections 62 corresponding to the respective ejecting electrodes 63 are formed at one edge of the ejecting port 61 and a head or pressure difference between the ink reservoir and ink chamber 53 causes the ink 34 to flow at a constant flow rate in a given direction.

With the present printing head 54, since the ejecting electrodes 63 are interconnected within the ejecting port 61, thus a mechanical strength at the ejecting position is increased, and its reliability becomes high.

Next, a third embodiment of the present invention will be explained.

Figure 18:
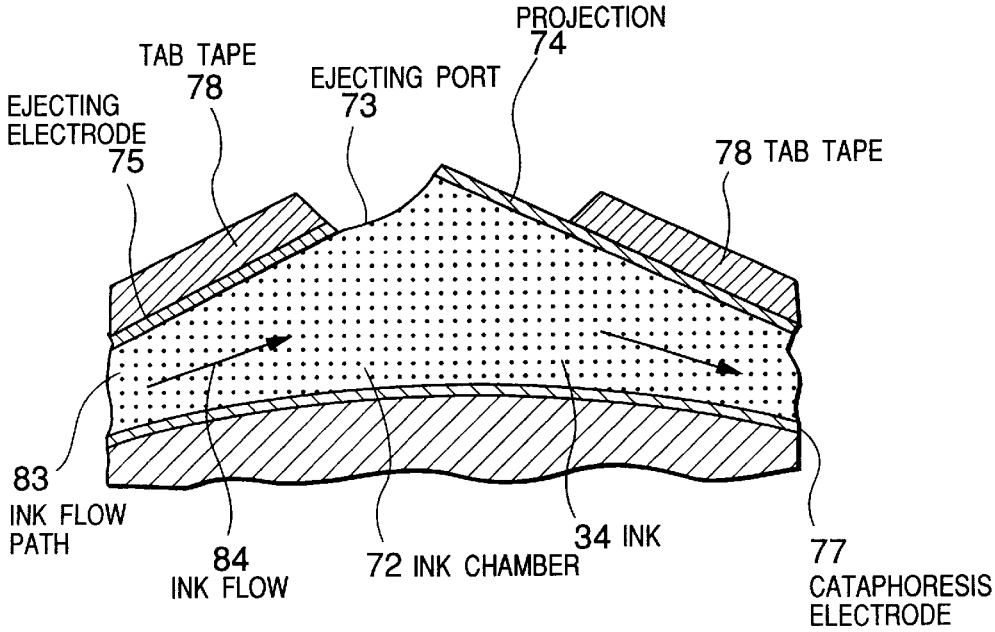
FIG. 18 is a cross-sectional view taken along line 18—18 in FIG. 17.
Figure 19:
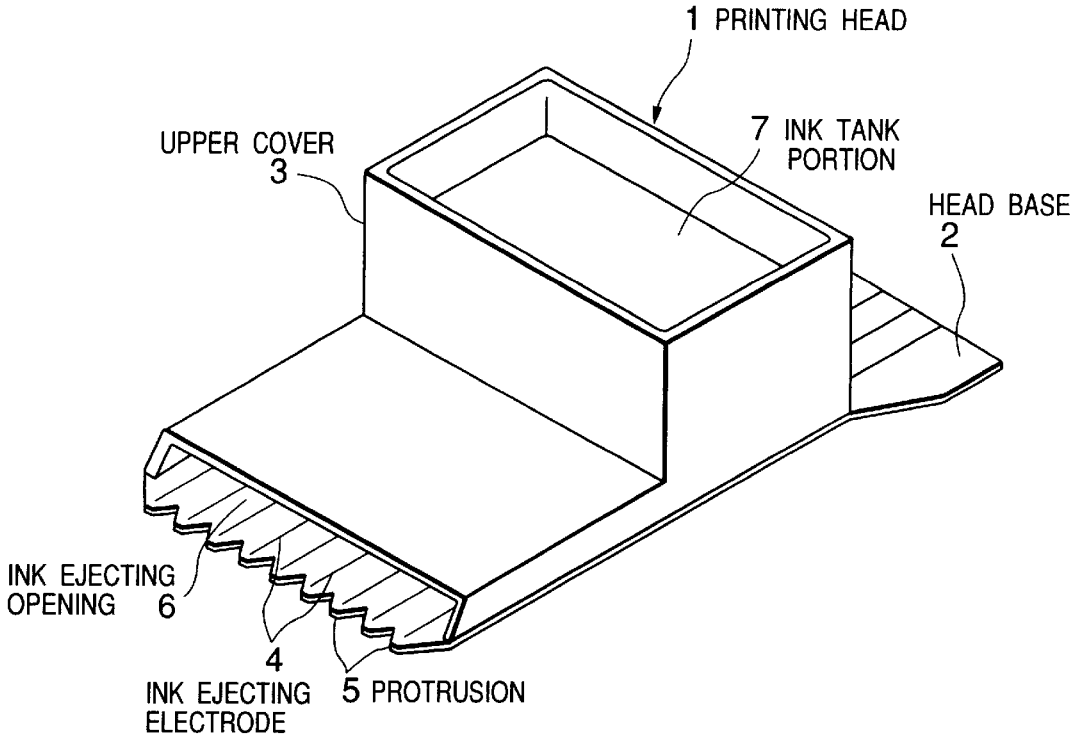
Fig. 19 PRIOR ART
FIG. 19 is a perspective view of a prior art printing head.
Figure 20:
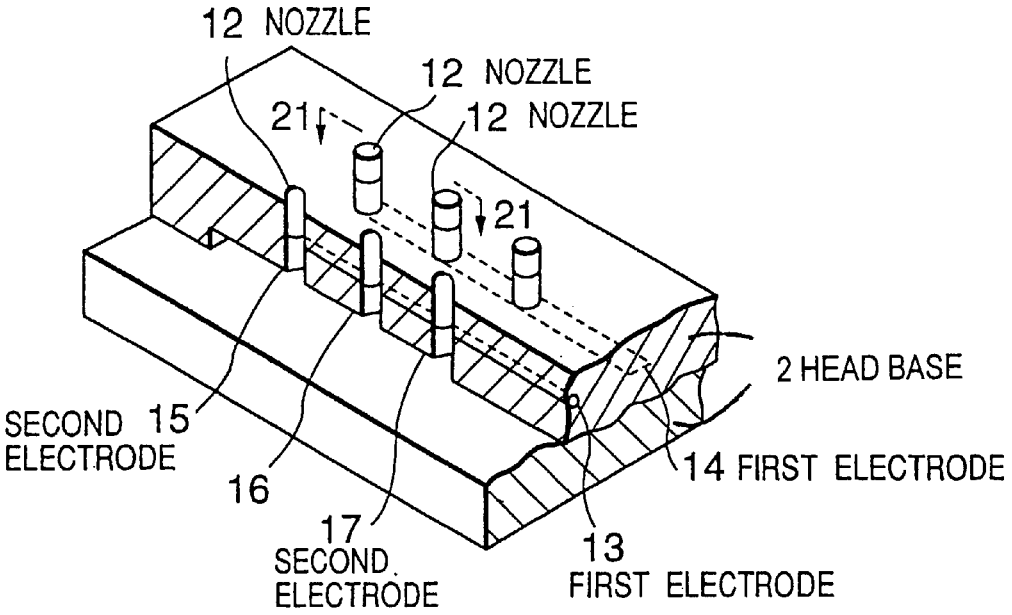
Fig. 20 PRIOR ART
FIG. 20 is a perspective view of major parts of a prior art printing head.
Figure 21:
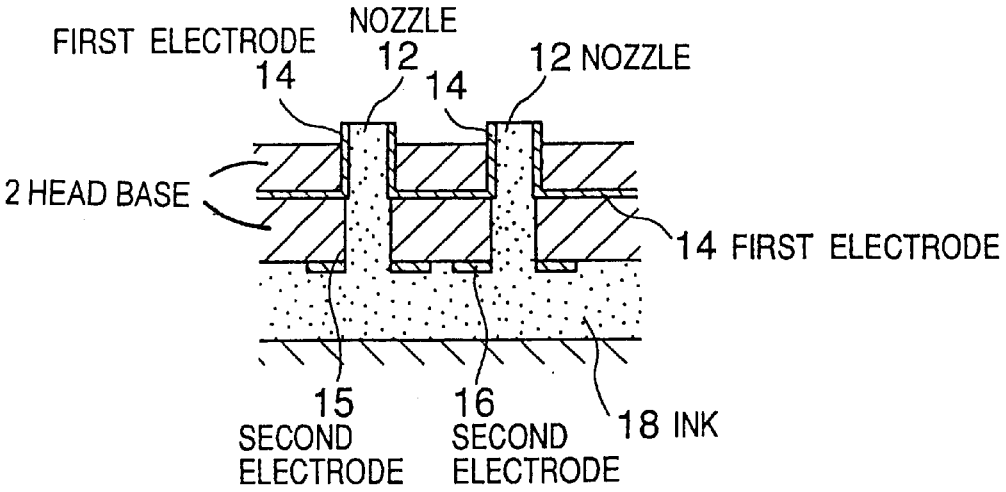
Fig. 21 PRIOR ART
FIG. 21 is a cross-sectional view taken along line 21—21 in FIG. 20.

Referring to FIGS. 14–18, in this embodiment, the projected part of the head block main body 71 has a cylindrical shape. The ejecting ports 73, which are arranged in a row on a top of the curved TAB tape 78, are formed at a pitch of a desired printing resolution. Each ejecting port 73 is surrounded at least at its sides by the ejecting electrodes 75, and the associated inner lead projects into the interior of the ejecting port 73 from its remaining side. The inner leads extend outwardly as shown in FIG. 18 when the TAB tape 78 is curved according to the cylindrical shape of the head block main body 71. In this embodiment, if the positions where the TAB tape 78 is bonded on the head block main body 71 or the positions of each ejecting port 73 in a TAB tape are different from predetermined positions or from one another, the inner leads can nevertheless project similarly and the difference of such positions are less critical than in the other two embodiments. Thus, the present invention seldom encounters serious manufacturing error caused by imprecise assembly and the invention can be inexpensively manufactured with high reliability and good yield.

In addition, a gate plate 79 is provided spaced from the ejecting ports 73 by a constant distance in its ejecting direction. The gate plate 79 has a gate hole 80 and the gate electrode 76. A counter-electrode is provided beyond the gate electrode 76 from the ejecting ports 73 in the ejecting direction and which is spaced by a constant distance. A row of the ejecting ports 73 are disposed parallel to the gate plate 79 and counter-electrode.

Figure 16:
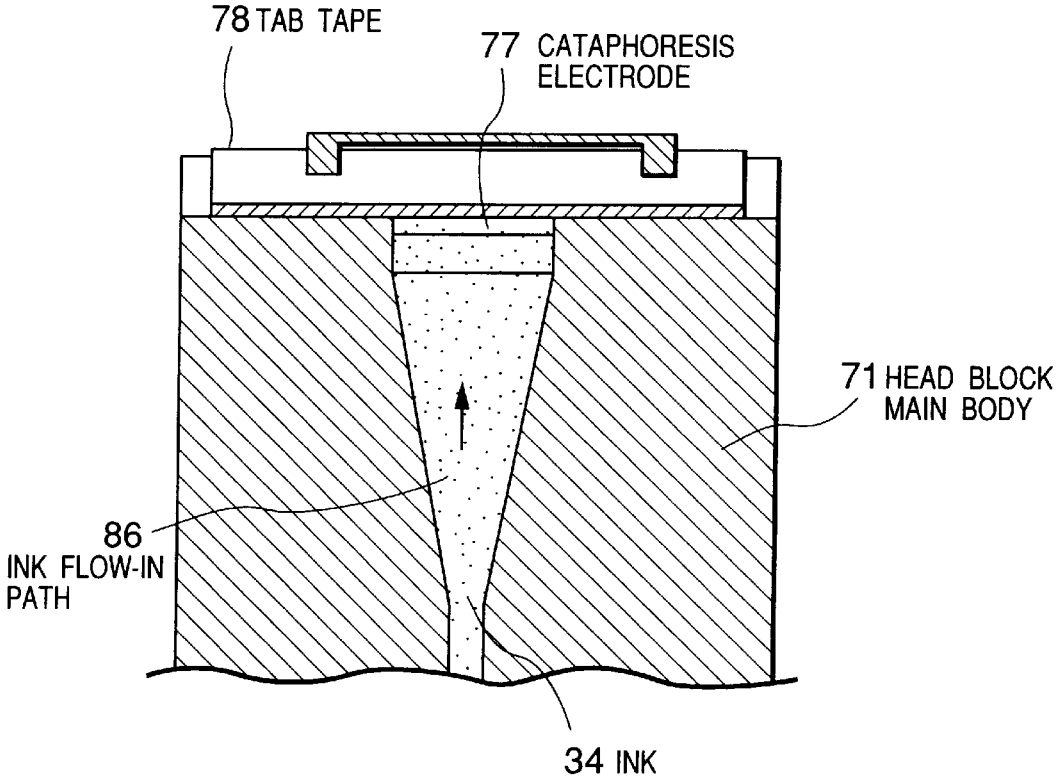
FIG. 16 is a cross-sectional view taken along line 16—16 in FIG. 15.
Figure 17:
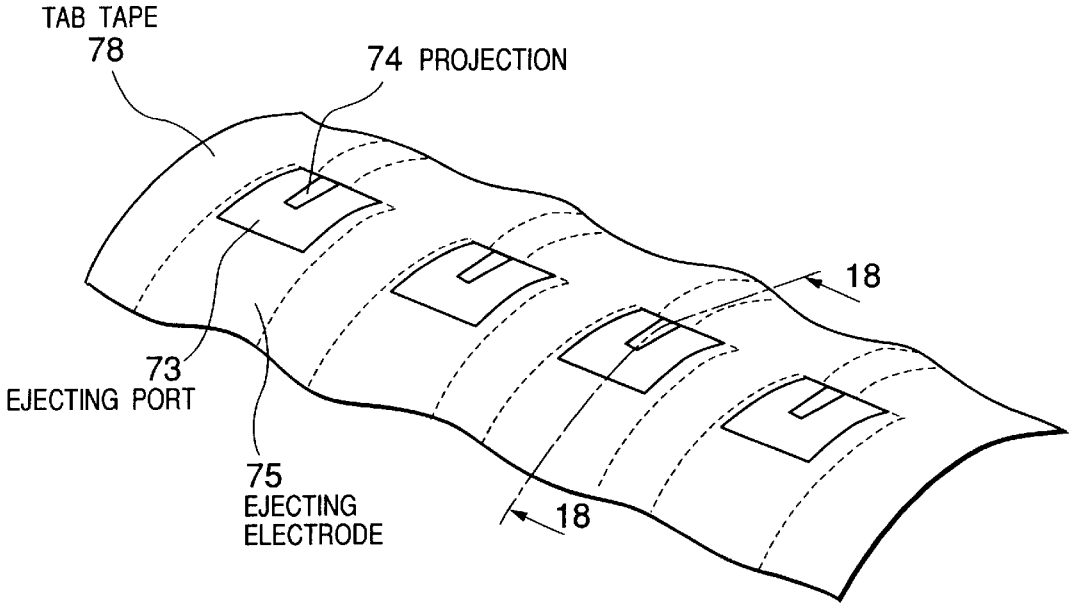
FIG. 17 is an enlarged perspective view of the part D in FIG. 15 showing an example of a TAB tape.

The ink 34 introduced from an ink supply port 81 into an ink flow path 83 is passed through a gap defined between the ejecting ports 73 and cataphoresis electrode 77 and then discharged out of the ink chamber 72 and circulated to ink reservoir through ink outlet port 82. In the vicinity of the ejecting ports 73, the TAB tape 78 is curved and the ink chamber 72 is defined as a curved space along the TAB tape 78 so that an ink flow 84 is always directed toward the ejecting ports 73, whereby the ink 34 in the vicinity of the ejecting ports 73 is always replaced by the circulating ink flow 84. The ink flow-in path 86 connected to ink supply port 81 expands in width as it approaches the ink chamber 72 as shown in FIG. 16 so that the ink flow 84 to every ejecting port 73 is constant and stable.

Although the present invention has been explained in the foregoing in connection with the preferred embodiments, the electrostatic ink-jet printing head of the present invention is not limited only to the arrangement of the above embodiments. Thus, the present invention also includes, within the scope of the invention, electrostatic ink-jet printing heads modified and changed in various ways from the arrangement of the above embodiments.

What is claimed is:

1. An electrostatic ink-jet printing head comprising:

a head block main body which defines an ink chamber in which ink is supplied prior to printing, said ink circulating in said ink chamber; and a tape member comprising a plurality of ejecting electrodes, a plurality of ejecting projections corresponding to respective ejecting electrodes, and at least one ejecting port having at least one of said ejecting projections extending into said ejecting port, said tape member being mounted on said ink chamber such that each said ejecting port is positioned in front of said ink chamber and each said projection projects outwardly of said ink chamber by bending said tape member in a vicinity of said projections.

2. The electrostatic ink-jet printing head of claim 1, wherein said head block main body includes an ink flow-in path and an ink flow-out path through which ink circulates, said ink flow-in path facing said at least one ejecting port.

3. The electrostatic ink-jet printing head of claim 1, wherein said ejecting projections are positioned in at least one row, and said head block main body includes an arris line aligned with said row of projections, said film member being bent at said arris line when mounted on said head block main body.

4. The elestrostatic ink-jet printing head of claim 1, wherein said film member has a single ejecting port and a plurality of said projections extending in a saw-tooth form from one edge of the ejecting port into the ejecting port.

5. The electrostatic ink-jet printing head of claim 1, wherein said plurality of ejecting electrodes are formed on said film member and span said at least one ejecting port adjacent said plurality of projection parts.

6. The electrostatic ink-jet printing head of claim 1, wherein said head block main body includes a cylindrical surface protruding in an ejecting direction and said film member is bent according to said cylindrical shape of said head block main body when mounted on said head block main body.

7. The elestrostatic ink-jet printing head of claim 1, wherein said ejecting projections are made in a form of said ejecting electrode formed on said film member.

8. The electrostatic ink-jet printing head of claim 1, wherein said ink chamber includes a curved space adjacent said projections, the ink circulating through said ink chamber.

9. An electrostatic ink-jet printing head comprising:

a head block main body which defines an ink chamber in which ink is supplied prior to printing, said ink circulating in said ink chamber; and a tape member covering said ink chamber, comprising a plurality of ejecting electrodes, a plurality of ejecting projections corresponding to respective ejecting electrodes, and a plurality of ejecting ports each formed in front of said ink chamber a single ejecting projection extending thereinto, said tape member being mounted on said ink chamber such that said projections protrude outwardly of said ink chamber by bending said tape member in a vicinity of said projections.

10. The electrostatic ink-jet printing head of claim 9, wherein at least half of a peripheral edge length of each said ejecting port is covered with the corresponding ejecting electrode.

11. The electrostatic ink-jet printing head of claim 9, wherein said head block main body includes an ink flow-in path and a ink flow-out path through which ink circulates, said ink flow-in path facing said ejecting ports.

12. The electrostatic ink-jet printing head of claim 9, wherein said projections are positioned in at least one row, and said head block main body includes an arris line aligned with said row of said projections, the film member being bent at said arris line when mounted on the head block main body.

13. The electrostatic ink-jet printing head of claim 9, wherein said head block main body includes a cylindrical surface protruding in the ejecting direction, the film member being bent according to said cylindrical shape when mounted on the head block main body.

14. The elestrostatic ink-jet printing head of claim 9, wherein said ejecting projections are made in the form of said ejecting electrode formed on said film member.

15. The electrostatic ink-jet printing head of claim 9, wherein said ink chamber includes a curved space adjacent said projections, the ink circulating through said ink chamber.

16. An electrostatic ink-jet printing head comprising:

an ink chamber filled with insulating ink containing charged toners prior to printing, in which said ink circulates;

a tape member covering said ink chamber, having formed therein ejecting ports, ejecting electrodes and ejecting projections by a tape automated bonding (TAB) technique, said plurality of ejecting ports being each formed in front of said ink chamber with a single electing projection extending thereinto, and which is mounted on said ink chamber such that each said ejecting port of the tape member is positioned in front of said ink chamber and is curved in a vicinity of said ejecting ports, said ejecting ports communicating between the ink chamber and the exterior of the head, said ejecting projections being provided within the ejecting ports as ink ejecting points, said ejecting electrodes being positioned in a vicinity of the ejecting projections for causing toners to be externally ejected from the ejecting projections under the influence of an electrostatic force based on a pulse voltage applied thereto;

a gate electrode disposed parallel to a row of tip ends of the ejecting electrodes at a position spaced by a constant distance from the ejecting electrodes in an ejecting direction;

a cataphoresis electrode positioned in the ink chamber on an opposite side of the ejecting ports for causing toners to concentrate at said ejecting ports by an electrophoresis phenomenon; and a counter-electrode disposed parallel to a row of the tip ends of the ejecting electrodes at a position spaced by a constant distance from the gate electrode in said ejecting direction.

17. The electrostatic ink-jet printing head of claim 16, wherein said ink chamber includes an ink flow-in path and an ink flow-out path through which ink circulates.

18. The electrostatic ink-jet printing head of claim 16, wherein said ejecting projections are positioned in at least one row, and said ink chamber includes a cylindrical surface protruding in an ejecting direction and said film member is bent according to said cylindrical shape of said ink chamber when mounted on said ink chamber.

19. The electrostatic ink-jet printing head of claim 16, wherein said ejecting projections are made in the form of said ejecting electrode formed on said film member.

20. The electrostatic ink-jet printing head of claim 16, wherein said ink chamber includes a curved space adjacent said projections, the ink circulating through said ink chamber.

* * * * *